United States Patent [19]

Labbe

[11] Patent Number: 4,832,058

[45] Date of Patent: May 23, 1989

[54] CIGARETTE MANUFACTURE

[75] Inventor: Francis A. M. Labbe, Neuilly-sur-Seine, France

[73] Assignee: Molins PLC, London, England

[21] Appl. No.: 401,303

[22] Filed: Jul. 23, 1982

[30] Foreign Application Priority Data

Jul. 24, 1981 [GB] United Kingdom ..... 8122910
Jul. 24, 1981 [GB] United Kingdom ..... 8122913

[51] Int. Cl.[4] ..... A24C 5/39
[52] U.S. Cl. ..... 131/110; 131/108
[58] Field of Search ..... 131/84 B, 109 B, 110, 131/280, 108, 109.1; 302/13, 11, 12, 27, 28; 406/89, 91, 85, 95, 138, 142; 198/766

[56] References Cited

U.S. PATENT DOCUMENTS 3,544,167 12/1970 Fuchu et al. ..... 131/110
4,050,741 9/1977 Dickinson ..... 131/110
4,390,029 6/1983 Leckband ..... 131/110
4,483,350 11/1984 Ruffer ..... 131/110

*Primary Examiner*—V. Millin
*Attorney, Agent, or Firm*—Antonelli, Terry & Wands

[57] ABSTRACT

A method of and apparatus for feeding tobacco pneumatically from a common supply station and substantially continuously to a number of cigarette making machines, in which tobacco is drawn from a common tobacco-spreading feed table at the supply station by a number of pipes leading to the respective cigarette making machines at an average controlled rate for each pipe which corresponds to the rate at which tobacco is used by the corresponding cigarette making machine.

In one preferred form of apparatus, each feed pipe includes a buffer which receives all the tobacco drawn intermittently into the pipe and from which tobacco is fed continuously at a variable rate into a downstream portion of the pipe.

15 Claims, 7 Drawing Sheets

CIGARETTE MANUFACTURE

This invention is concerned particularly with pneumatically feeding tobacco substantially continuously to a number of cigarette making machines from a common source. In this context the reference to a tobacco feed being "substantially continuous" means that the system is capable of delivering a metered supply of tobacco at a rate slightly in excess of the rate at which tobacco is consumed by the cigarette making machine. Each cigarette making machine preferably has a small buffer capacity; whenever the buffer is full, a signal is emitter to slow down temporarily the supply of tobacco, or possibly to stop it briefly (while the air flow preferably continues). Thus, although the delivery of tobacco is not at a constant rate, it i s nevertheless substantially continuous, so that the velocity at which tobacco is conveyed to each cigarette making machine can be kept relatively low with consequent minimal breakage of the tobacco.

The flow of tobacco is preferably literally continuous (though at a varying rate) so that the tobacco used to make every portion of the continuous cigarette rod is a blend of fresh tobacco and discard tobacco, as described in our British patent application No. 8211140.

According to this invention there is provided a method of feeding tobacco pneumatically from a common supply station and substantially continuously to a number of cigarette making machines, in which tobacco is drawn from a common tobacco-spreading feed table at the supply station by a number of pipes leading to the respective cigarette making machines at an average controlled rate for each pipe which corresponds to the rate at which tobacco is used by the corresponding cigarette making machine.

Preferred methods according to this invention and related apparatus for putting such methods into effect will be made clear in general terms by the appended claims. The following description gives examples of specific preferred forms of apparatus, each apparatus description being preceded by explanatory statements. In the drawings:

Figure 1:
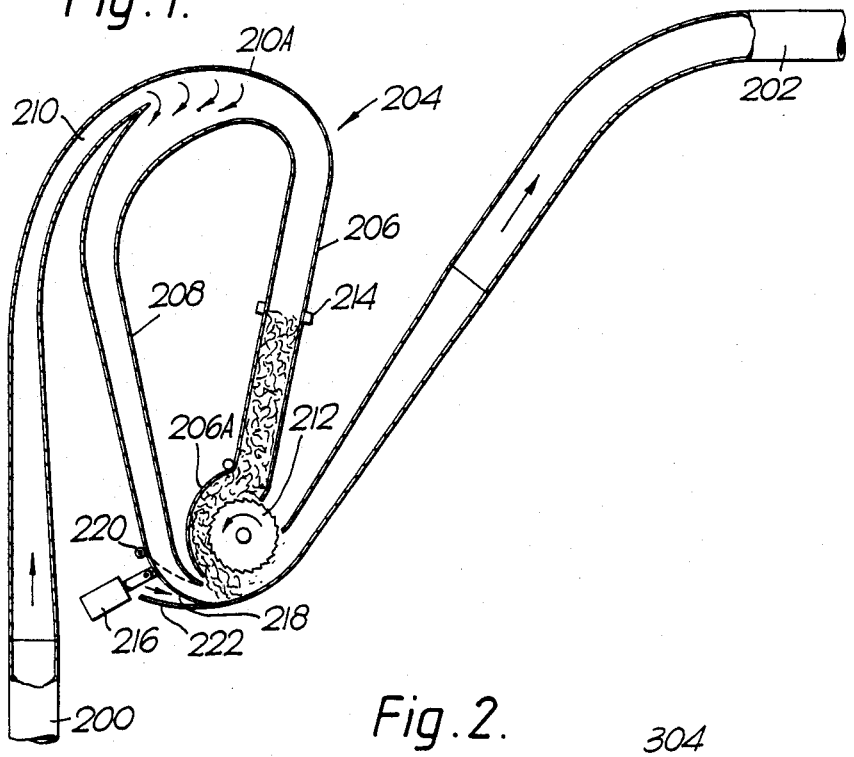
FIG. 1 shows one of a number of tobacco feed pipes including a buffer.
Figure 2:
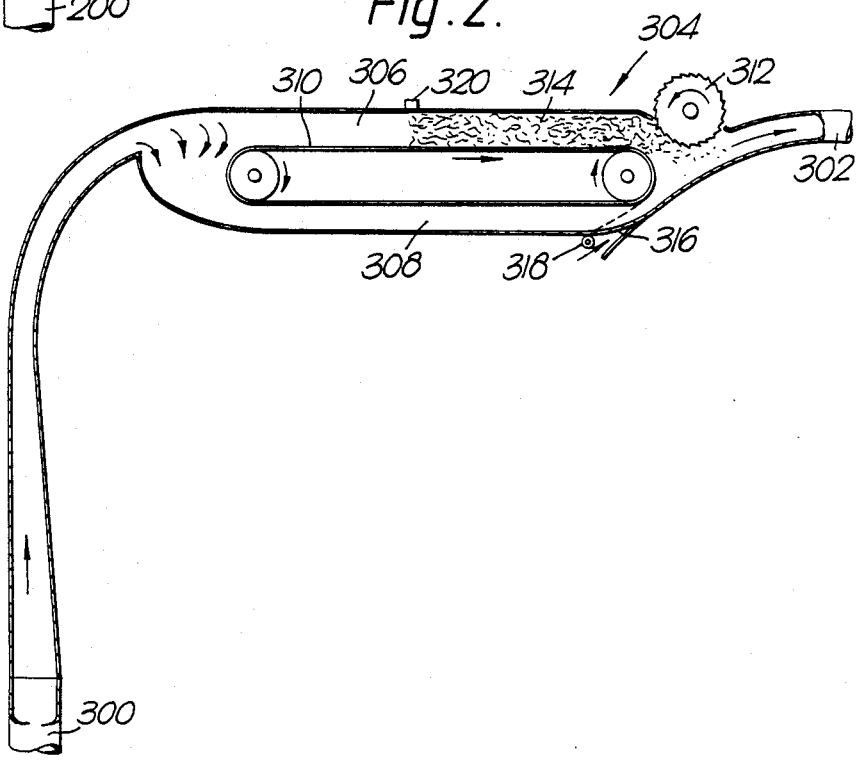
FIG. 2 shows a modification of the arrangement shown in FIG. 1.

FIGS. 1 and 2 show examples of a pneumatic feed pipe for feeding tobacco substantially continuously to a cigarette making machine from a common supply station (i.e. common to a number of cigarette making machines), each feed pipe including in general terms an inlet for receiving tobacco, an outlet for feeding tobacco pneumatically to a cigarette making machine, and an intermediate portion consisting of generally parallel pipe portions of which one portion serving as a buffer is arranged to receive tobacco delivered into the pipe inlet and has metering means for feeding tobacco at a controlled rate from its downstream end, while air drawn into the pipe inlet passes through the second pipe portion, at least while the pipe is drawing in tobacco through its inlet.

This arrangement enables a continuous feed of tobacco to be made from the first intermediate pipe portion, which can be supplied intermittently with tobacco from the pipe inlet. In other words, this arrangement is capable of converting a discontinuous tobacco feed, from the supply station, to a continuous feed to the cigarette making machine. The parallel pipe portions may extend downwards, in which case gravity assists downward movement of the pile of tobacco in the first portion; alternatively, the parallel pipe portions may extend horizontally, and the first portion may have a lower wall formed by a continuously moving smooth conveyor band capable of applying a small frictional force driving the tobacco towards the metering means, while being capable of slipping with respect to the tobacco while tobacco is being fed by the metering means at a relatively low rate. In each case, the metering means may comprise a roller, e.g. with a ribbed outer surface.

The means for supplying tobacco intermittently into a number of pipes leading respectively to different cigarette making machines may comprise a vibratory circular feed table basically as described in British patent specification No. 1520424.

The feed pipe shown in FIG. 1 includes an inlet part 200 which is arranged to receive tobacco intermittently from any form of tobacco feed table, being preferably arranged to suck up tobacco from the feed table, and a part 202 which is arranged to deliver tobacco substantially continuously to a cigarette making machine. Between these two parts there is an intermediate portion 204 comprising generally parallel portions 206 and 208 which communicate with one another at their inlet ends and also at their outlet ends.

A part 210 of the pipe assembly is curved so that tobacco conveyed through it is thrown by centrifugal force against the outer wall 210A, along which the tobacco slides until it enters the pipe portion 206. Air entering through the part 210 of the pipe assembly, on the other hand, bypasses the tobacco-containing pipe portion 206 and passes instead through the pipe portion 208.

A ribbed metering roller 212 at the lower end of the pipe portion 206 rotates in a counter-clockwise direction so as to feed tobacco from the pipe portion 206 into the area of the junction between the downstream ends of the pipe portions 206 and 208, from which position the tobacco is conveyed pneumatically to the cigarette making machine via the part 202 of the pipe assembly. Air for this last purpose, while tobacco is being fed into the pipe portion 206, is derived from the air flow through the pipe portion 208. When tobacco piles up in the pipe portion 206 to the level of a photoelectric or other detector 214, the detector automatically causes an actuator 216 to extend so as to rotate a pivoted member 218 about its pivot 220 (to the position shown in broken outline). As a result, air can no longer flow through the pipe portion 208 (and therefore no longer draws up tobacco from the source communicating with the part 200); instead, air enters through the vent which is then created between the member 218 and a fixed part 222, thus enabling tobacco to continue to be fed pneumatically through the part 202 of the pipe assembly from the portion 206.

In FIG. 1, the duct 206 includes a wall portion 206A which extends around the metering roller 212 and is pivoted about its upper end so that it is free to swing in a clockwise direction in response to the pressure of the tobacco passing around the metering roller. Also in FIG. 1 it should be noted that the part of the wall of duct portion 208 lying opposite to the pivoted part 218 converges towards the part 218 so as to increase the velocity of the air as it approaches the metering roller 212.

The following modification of FIG. 1 is possible. Control of the delivery of tobacco into the part 200 of the pipe may be achieved by means of a pivoted flap which is swung open to admit air from the atmosphere into the part 200 of the pipe, which then ceases to suck up tobacco from the feed table. Air can then continue to flow through the pipe portion 208 to continue the pneumatic conveyance of tobacco from the pipe portion 206, and into the part 202. There is then no need for control of the member 218.

FIG. 2 shows an alternative pipe assembly. Between parts 300 and 302 there is an intermediate portion 304 comprising parallel portions 306 and 308 which in this instance extend horizontally. The floor of the tobacco-receiving portion 306 is formed by a smooth conveyor band 310 which is driven continuously so as to urge towards a metering roller 312 the horizontal column of tobacco 314 which piles up in the portion 306 in the same manner as in FIG. 1.

As in FIG. 1, there is an air control member 316 at the downstream end of the pipe portion 308. The member 316 is pivoted at 318 and is automatically raised by means of any appropriate actuator (not shown) to stop the flow of air and tobacco through the part 300 of the pipe assembly when sufficient tobacco has piled up in the portion 306, as indicated by a detector 320. However, as described in relation to FIG. 1, the pivoted member 316 may be replaced by means for admitting air into the part 300 of the duct when delivery of tobacco into the pipe portion 306 is required to stop.

The conveyor band 310 may be replaced by a vibrating tray. In either case, the band or tray may be of a width such that it is common to a number of pipe assemblies, each having a separately driven roller 312 to control the delivery of tobacco into the part 302 of the corresponding pipe assembly.

As an idea of scale, the duct 200 may comprise a 100 mm diameter pipe. FIG. 1 shows it becoming narrower towards the curved portion 210. It may in fact change progressively from the circular cross-section to a flat rectangular cross-section (e.g. 200×40 mm or even 250×40 mm) of similar or somewhat larger cross-sectional area. The same applies to FIG. 2. The thickness of the buffer column of tobacco may in each case, if well loosened tobacco is used, be somewhat less than that illustrated; for example it may be as little as 50 mm.

FIGS. 3 to 6 show examples of different forms of apparatus according to this invention comprising at the supply station a circular vibratory feed table arranged to convey tobacco along a circular path and having openings through each of which tobacco is arranged to drop into a buffer column associated with one of the cigarette making machines, and including a metering device at the lower end of each buffer column for feeding tobacco from the buffer column at a controlled rate into a feed pipe arranged to convey the tobacco pneumatically to the corresponding cigarette making machine, each opening having means controlling the passage of tobacco into the corresponding buffer column from the feed table.

Figure 3:
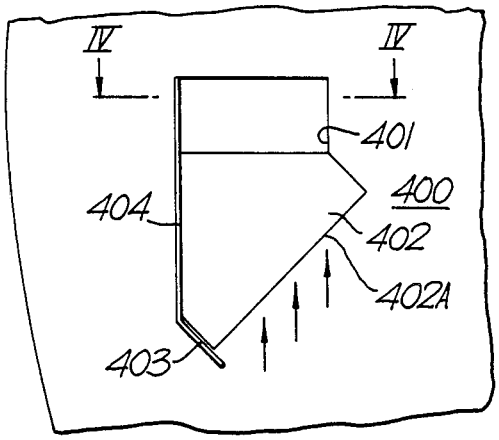
FIG. 3 shows a different example, including a circular vibratory feed table arranged to feed tobacco to a number of buffers below the feed table.

FIG. 3 shows one of a number of openings 401 in a circular vibratory table 400, it being understood that the different openings are at different distances from the center of the table.

Tobacco approaches the opening 401 generally in the direction of the arrows shown in FIG. 3 as a result of the vibratory motion of the table about its vertical axis. Immediately upstream of the opening, the surface of the table is formed by a part 402 which is pivotally mounted with respect to the remainder of the table along its edge 402A, so that it can either lie in the plane of the table (and permit tobacco to drop through the opening 401) or can be swung upwards to a substantially vertical position in which it deflects the tobacco past the opening. It will be understood that, with the member 402 in an upright position, all the tobacco which reaches it will be deflected to the right of the opening 401. An inclined fixed wall 403 on the table deflects to the left the tobacco approaching the left-hand edge of the part 402, while a further fixed wall 404 helps to ensure that tobacco moving past the left-hand side of the opening 401 cannot spread to the right and thereby drop through the opening.

Tobacco dropping through the opening 401 falls onto the upper end of an inclined ramp 405 which has side walls 406 and carries diverging vanes 407 which tend to spread the tobacco across a greater width. The upper end of the ramp may lie directly below the upstream the part 402 (i.e. below the left-hand end of that edge which is furthest upstream) so that any tobacco which falls through the running clearance between the side edges of the part 402 and the remainder of the plate falls on the ramp and is conveyed along with the remainder of the tobacco so as to enter a column buffer formed partly by vertical walls 408 and 409. Tobacco piles up in this column and is fed continuously from the lower end of the column by a ribbed feed roller 410 in the manner shown in FIG. 1 in connection with ribbed roller 212, and into a pipe 412 leading to a corresponding cigarette making machine.

A photoelectric device 411 detects when the column 408, 409 is nearly full, and causes the pivoted part 402 of the feed table to be raised by an associated actuator (not shown).

In place of the vertically extending buffer column 408, 409, there may be a horizontally extending buffer column formed by a conveyor (substantially like the conveyor 310 in FIG. 2) onto which the ramp 405 is arranged to feed the tobacco.

Figure 4:
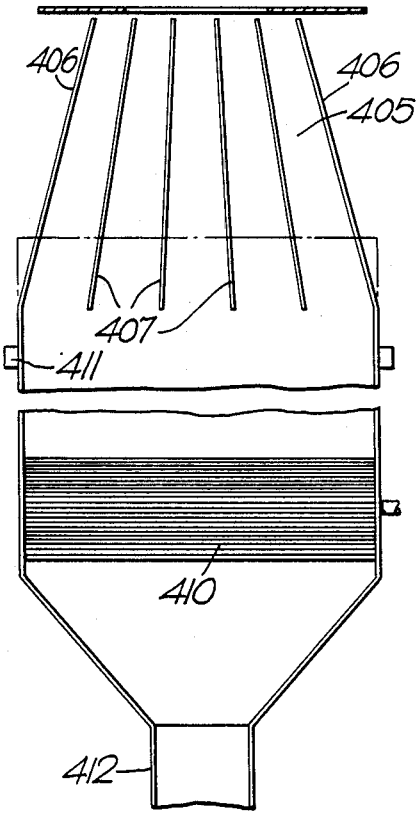
FIG. 4 is a section on the line IV—IV in FIG. 3.
Figure 5:
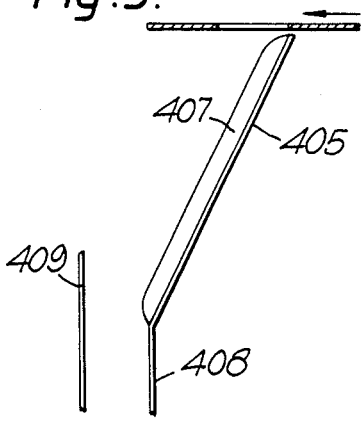
FIG. 5 is a view from the right of FIG. 4.
Figure 6:
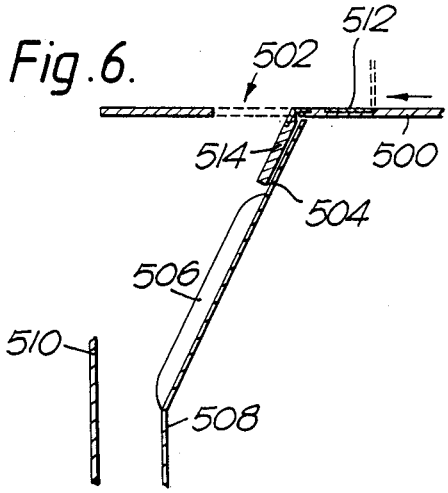
FIG. 6 shows a modification of the apparatus shown in FIGS. 3 to 5.

FIG. 6 shows a modification of the vibratory feed device of FIGS. 3 to 5. It is a vertical section, in the direction of movement of the tobacco, in the region of one of a number of openings 502 in the feed table 500. Below the opening there is a ramp 504 with diverging vanes 506 for feeding tobacco into a wider buffer column formed by vertical walls 508 and 510, as in FIGS. 4 and 5.

When the buffer column is full and therefore requires the delivery of tobacco to stop temporarily, a pivoted stop flap 512 in front of the opening is automatically swung to a vertical position (shown in broken outline) to hold up the flow of tobacco towards the opening. Then, after a short delay sufficient to allow all the tobacco between the flap 512 and the opening to pass into the buffer column, a clap 514 is automatically swung upwards to a horizontal position in which it closes the opening, whereupon the stop flap 512 is again lowered automatically to its horizontal position to allow the tobacco to continue on its way, passing over the flap 514. When the buffer column again calls for tobacco, as indicated by a photoelectric or other detector, the flag 514 is automatically lowered.

The flaps 512 and 514 (as also the pivoted member 402 in FIG. 3) may be pivoted to the main body of the table by hinges formed by strips of flexible material. Movement of the flags in the desired manner may be effected by actuators (e.g. electrical or pneumatic) slung beneath the table.

In FIG. 6 each opening 502 may be elongated as in FIG. 3; its major axis may be radial with respect to the table, or may be inclined to a radius. Delivery of tobacco from the buffer (which may be horizontal instead of vertical) may be achieved in any of the ways described above with regard to FIGS. 3 to 5.

In FIG. 6 the stop flap 512 may be replaced by other means for temporarily holding up the tobacco approaching the corresponding opening to ensure that there is no tobacco on or adjacent to the flap 514 when it is raised to close the opening, the presence of such tobacco, being undesirable because there would be a risk of it being crushed and damaged if it is caught between an edge of the flap 514 and the corresponding edge of the opening. Alternative means may comprise an opening in the table covered by a fine mesh (e.g., of expanded metal) or by a forwardly facing louvre through which light suction can be applied to grip and thus hold up the tobacco. Any small particles of tobacco which fall through the mesh or louvre (especially while suction is being applied) may be arranged to pass into the pipe which conducts tobacco from the bottom of the corresponding buffer column; for that purpose the suction applied below the latter opening may be derived directly from that pipe.

In the examples described with reference to FIGS. 3 to 6 the openings in the table may vary in width according to the distance from the center of the table, the width being greater the closer the opening is to the center, so that the tobacco delivery rate through the various openings is approximately the same. That is on the basis that tobacco near the periphery of the table is conveyed at a greater speed than tobacco closer to the center of the table, and is on the assumption that tobacco is delivered across the table to a substantially even thickness. As an alternative, tobacco may be delivered onto the table in a manner such that there is more tobacco, per unit of table area, in areas closer to the center of the table, thus allowing the openings in the table to be of substantially the same width (measured radially of the table); for example, tobacco may be delivered onto the table by a vibratory tray conveyor having an appropriately shaped concave delivery end such as to achieve the desired uneven distribution across the table.

The examples of feed apparatus shown in FIGS. 7 to 12 in general terms comprise a feed table located at a common supply station for a number of cigarette making machines, means for feeding tobacco onto the feed table, and a number of pipes associated with the respective cigarette making machines and arranged to suck up tobacco substantially continuously from the feed table for delivery pneumatically to the cigarette making machines, each pipe having an inlet of which the area lying above tobacco on the feed table is arranged to be controllable to vary the rate at which tobacco is sucked up from the feed table.

Dealing specifically with the examples shown in FIGS. 7 to 10, the feed table in each of those examples is arranged to rotate about a central vertical axis, tobacco fed into the table being distributed around the periphery of the table by or with the aid of centrifugal force. The feed table also includes a fixed annular roof member coaxial with the table and evenly spaced from the table so as to define an annular space of substantially uniform height across a radial dimension substantially greater than the said height, and in which each pipe communicates with the annular space near the periphery thereof via an aperture in the roof member.

The size of the aperture, measured with respect to the table, should be such that any given pipe can remove (by suction) only part of the tobacco in the annular space as the tobacco moves past the aperture during rotation of the table. Tobacco which is not removed by any given pipe (i.e. lying radially inwards of the aperture) forms a buffer and is flung outwards by centrifugal force to replace the tobacco removed by the pipe, thus enabling the next pipe to receive tobacco in the same way. Because of the uniform height of the annular space, each pipe can receive tobacco at a substantially predetermined rate which can be substantially the same for all the pipes (i.e. all those demanding tobacco at any particular instant), subject to any control which may be applied to allow deliberate alteration of the delivery rate of tobacco by any given pipe.

Control of the delivery of tobacco into each pipe may in general be achieved as follows. The outer wall of the annular space immediately upstream of each pipe is defined by a pivoted member which is pivoted at its upstream end (in relation to movement o f tobacco on the table) about an axis normal to the table, and is controlled as to its position about the pivot so as to vary the radial dimension of the tobacco which passes below the aperture. Thus, the amount of tobacco which is sucked up by the pipe is controlled. Each pivoted member may be manually adjusted, or may be adjusted by a servo-device responsive, for example, to the quantity of tobacco in the buffer space of the corresponding cigarette making machine.

The means for feeding tobacco into the annular space preferably comprises an approximately conical member coaxial with the table, surrounded by a second coaxial approximately conical member forming an approximately conical space of substantially uniform thickness between the two conical members. This conical space serves as an intermediate buffer; tobacco is delivered into it from above, and is delivered from it at its periphery by centrifugal force, the narrow end of the conical space being uppermost. The inner conical member is arranged to rotate to produce a centrifugal force tending to discharge the tobacco from the conical space and into the annular space when the speed of rotation is sufficiently high. Control of the discharge rate may be achieved by controlling the speed of rotation; however, in a preferred arrangement, the rotating conical member is arranged to rotate continuously at one of two speeds, one speed being sufficient to discharge tobacco while the other speed is insufficient. A photoelectric or other detector at or near the inner periphery of the annular space may be provided to detect when tobacco is required from the conical space.

The conical space serves as an intermediate buffer between the source of tobacco and the annular space. A photocell or other detector near the top of the conical space may be provided to discontinue the delivery of tobacco from the source into the conical space when the conical space is nearly full. An intermediate buffer as described above may be used to feed tobacco to other forms of rotary feed tables.

There are preferably circumferentially spaced vanes on the rotating conical member to assist in rotating the tobacco in the conical space.

The conical members are preferably externally concave in longitudinal section (i.e. in a plane containing their axes) so that the inclination of the wall of each conical member to the horizontal decreases at increasing distances from the axis.

Figure 7:
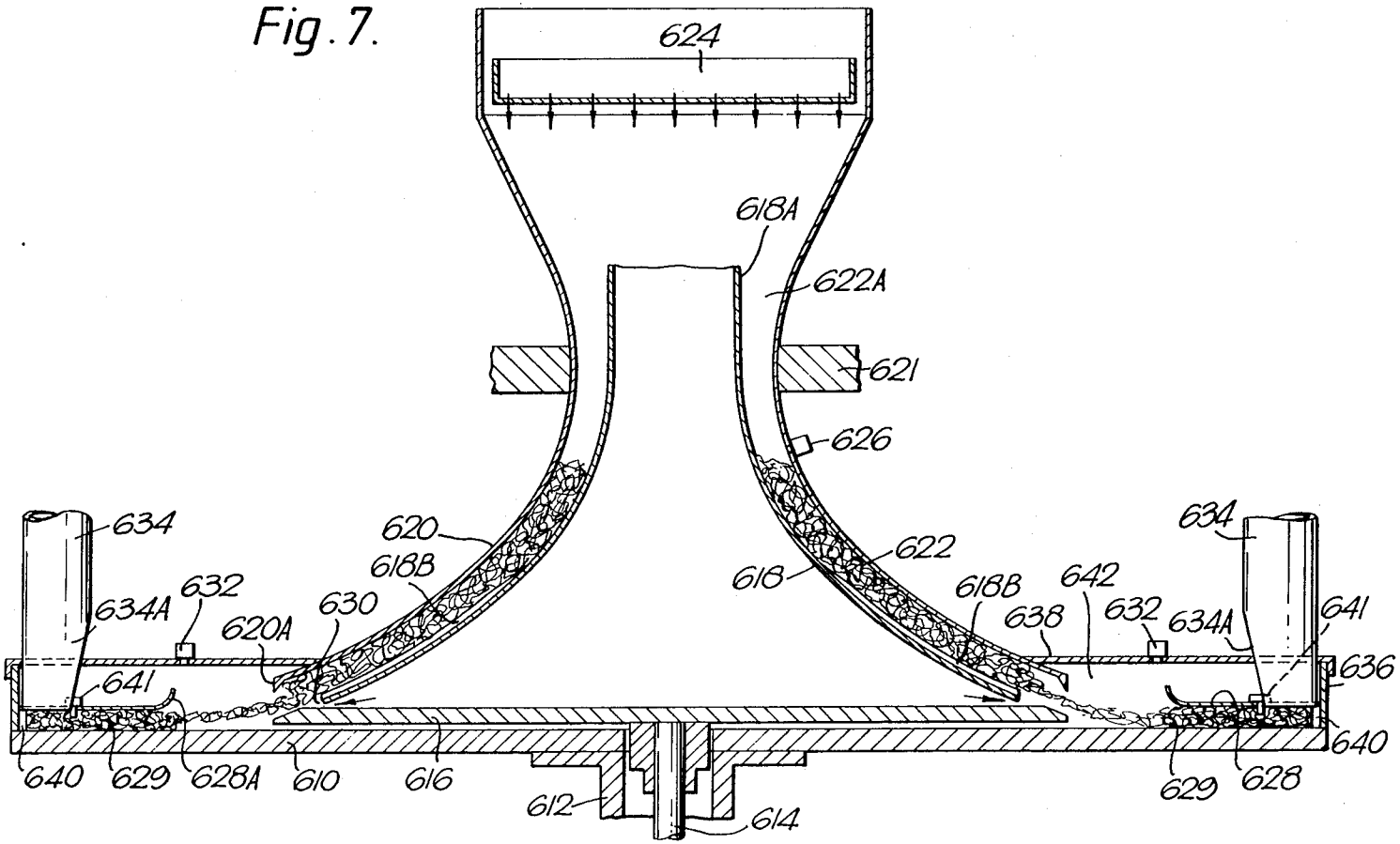
FIG. 7 is a vertical sectional view of another different feed apparatus.
Figure 8:
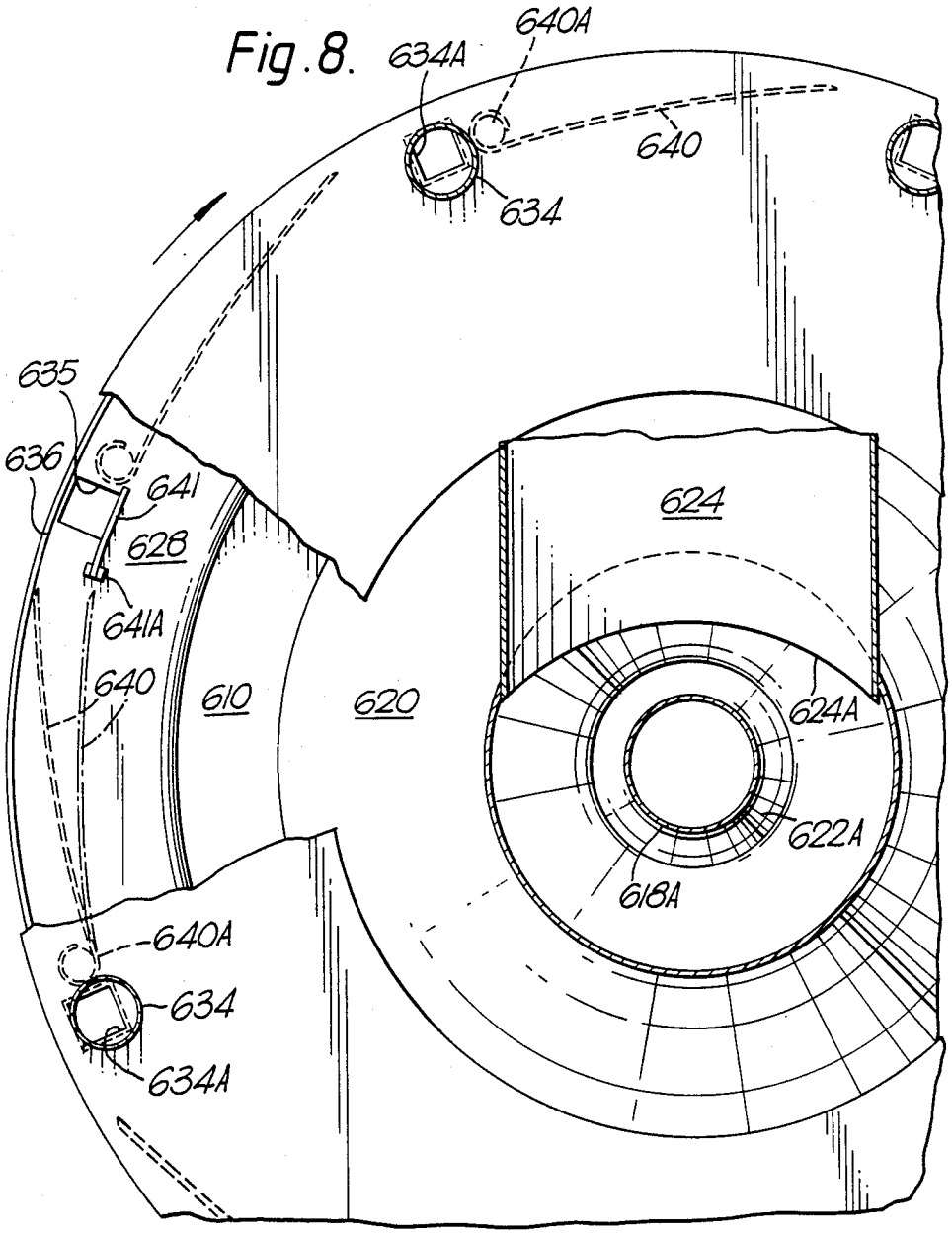
FIG. 8 is a plan view of part of the apparatus shown in FIG. 7.

With reference to the specific examples shown in the accompanying drawings, the apparatus shown in Figures 7 and 8 includes a rotary table 610 which is driven at a constant speed, for example 26 revolutions per minute (r.p.m.), by a hollow shaft 612. Within the shaft 612 there is a shaft 614 which carries a hollow approximately conical member comprising a base 616 and an approximately conical annular wall 618. Around the wall 618 there is a second similar wall 620 which is fixed to a stationary member 621 and is evenly spaced from the wall 618 to form a conical space 622 which serves as an intermediate buffer.

It should be noted that the wall 618 is only approximately conical, being concave in section as shown in FIG. 7. Apart from its upper end portion, the wall 618 describes part of a circle in cross-section. Its angle to the horizontal decreases towards the lower end.

The upper end portion 622A of the conical space 622 extends vertically to receive tobacco delivered by a vibratory tray 624 of which the downstream edge 624A is concave (see FIG. 8) so as to fit around a cylindrical extension 618A of the wall 618. A photoelectric detector 626 detects the height of tobacco in the annular space 622 and controls the feed rate from the vibratory tray so as to maintain tobacco in the annular space 622 to approximately the height of the detector 626.

Above the peripheral portion of the table 610 there is an annular roof member 628 defining an annular space 629 for tobacco of uniform height. Tobacco is delivered into this annular space from the space 622, when the inner conical member is rotating at an upper speed (e.g. 68 r.p.m.) partly as a result of centrifugal force and partly through the effect of air which is blown outwards through a gap 630 between the wall 618 and the base 616, air for that purpose being delivered (at above atmospheric pressure) into the space within the conical wall 618 via the upper cylindrical extension 618A. When the annular space 629 is full, as detected by a photoelectric detector 632, the speed of the drive to the shaft 614 is arranged to reduce automatically (e.g. to 26 r.p.m.) to a point at which centrifugal force and the action of the air jets is no longer sufficient to feed tobacco outwards from the conical space 622; to assist in achieving that, the outer periphery of the fixed conical wall 620 has a downwardly extending lip 620A forming a slight restriction at the outlet from the space 622.

A number of pipes 634 circumferentially spaced around the table 610 are arranged to deliver tobacco to respective cigarette making machines (not shown). Each pipe is, for the most part, of circular cross-section but has a lower end portion 634A which tapers in a downward direction and progressively changes to a rectangular cross-section. The lower end of each pipe engages in a corresponding rectangular aperture 635 in the annular roof member 628 through which the pipe is arranged to draw up tobacco from the annular space 629 at its outer periphery. As soon as tobacco is drawn up in this manner by one pipe 634, centrifugal force on the remaining tobacco in the annular space displaces that tobacco outwards towards the periphery of the table in readiness for the next pipe. Thus the tobacco in the annular space below the roof member 628 serves as a final buffer ensuring that ech pipe 634 can receive tobacco whenever it so demands, regardless of whether other pipes are at that time also drawing up tobacco.

Secured around the periphery of the table 610 there is a cylindrical wall 636 which, at its upper edge, forms a running seal with a fixed cover 638. However, in the vicinity of each pipe 634, the outer periphery of the annular space 629 is defined by a curved pivoted member 640. As shown in FIG. 8, each member 640 is pivoted at its upstream end 640A about a vertical axis. The limiting inner position of each member 640 (shown in broken outline) is such that the member 640 forms part of a circle (in plan) centered at the axis of rotation of the table 610. When a particular member 640 is in that position it causes the adjacent tobacco to bypass the inlet to the corresponding pipe 634, whereby no tobacco is drawn up into the pipe. As the member 640 is swung progressively outwards towards the wall 636, it allows progressively more tobacco to be drawn up by the corresponding pipe 634.

Adjacent to each aperture 635 in the roof member 628 there is a plate 641 which extends along the inner edge of the aperture and is pivoted about a horizontal axis at its upstream end 641A (in relation to movement of tobacco on the table). The plate passes downwards through a slot in the roof member 628 and is lightly spring-loaded downwards, e.g. by a torsion spring (not shown), so as to press lightly on the tobacco in the region of the aperture. This helps to ensure that each pipe sucks up substantially only tobacco which passes directly below the corresponding aperture, i.e. does not suck up any significant quantity of tobacco lying closer to the center of the table.

In practice, each member 640 may be arranged to alternate between two positions which feed respectively slightly more and slightly less tobacco than is consumed by the corresponding cigarette making machine when running at its normal speed. Movement of the member 640 may be controlled by a tobacco height detector in a buffer in the cigarette making machine, the feed rate being reduced when the tobacco reaches the height of the detector and being increased when the tobacco level falls below the detector. Alternatively, the position of each member 640 may be progressively controlled in response to a detector at the corresponding cigarette making machine.

In the space 642 below the cover 638 the pressure is preferably slightly below atmospheric pressure as a result of the suction applied via the pipes 634 and despite the air which is blown in through the gap 630. There may be a series of apertures (not shown) in the cover 638 to ensure that the suction pressure in the space 642 does not rise to such an extent as to suck tobacco from the annular space 622 while the shaft 614 is driving at the lower speed.

In order to ensure that the tobacco in the annular space below the roof member 628 is reliably driven by the table 610, the table 610 may be formed with shallow radial vanes (not shown) extending through a small proportion of the height of the annular space; such vanes may be omitted in the area swept by the pivoted members 640. Similarly, in order to ensure that the tobacco in the intermediate buffer space 622 rotates reliably with the inner conical member 618, the outer surface of the member 618 is formed with radial vanes 618B at regular circumferentially spaced positions. Towards the lower end of the wall 618 there may be additional radial vanes between the vanes 618B to avoid an excessive circumferential spacing between the vanes in that area.

An inner edge portion 628A of the annular roof member 628 is flared upwards in order to ensure that all the tobacco flung from the conical space 622 enters the annular space 629.

As an idea of scale, the diameter of the table 610 may be 1800 mm, and each pipe 634 may be of 100 mm diameter.

Figure 10:
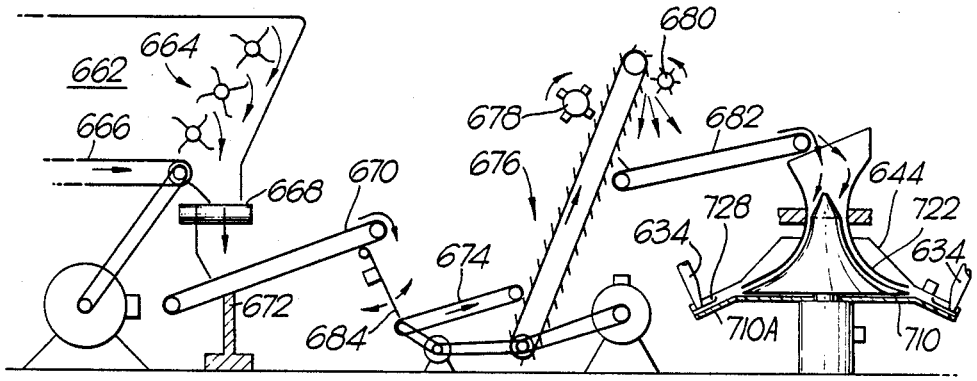
FIG. 10 is a view in the direction of the arrowX in FIG. 9.

An alternative construction suitable for a lower speed of rotation of the table is shown in FIG. 10. In accordance with that construction, the peripheral portion 710A of the table 710 is arranged to slope downwards, forming substantially an extension of the annular space 722. As in the previous example, an annular buffer of tobacco is formed by a roof member 728 which is uniformly spaced from the corresponding portion of the table (i.e., similarly inclined). Instead of air being blown horizontally (through the gap 630 in FIG. 7), it is blown in a direction substantially parallel to the inclined periphery of the table from a manifold defined above the fixed conical member 720 by a wall 744.

Figure 9:
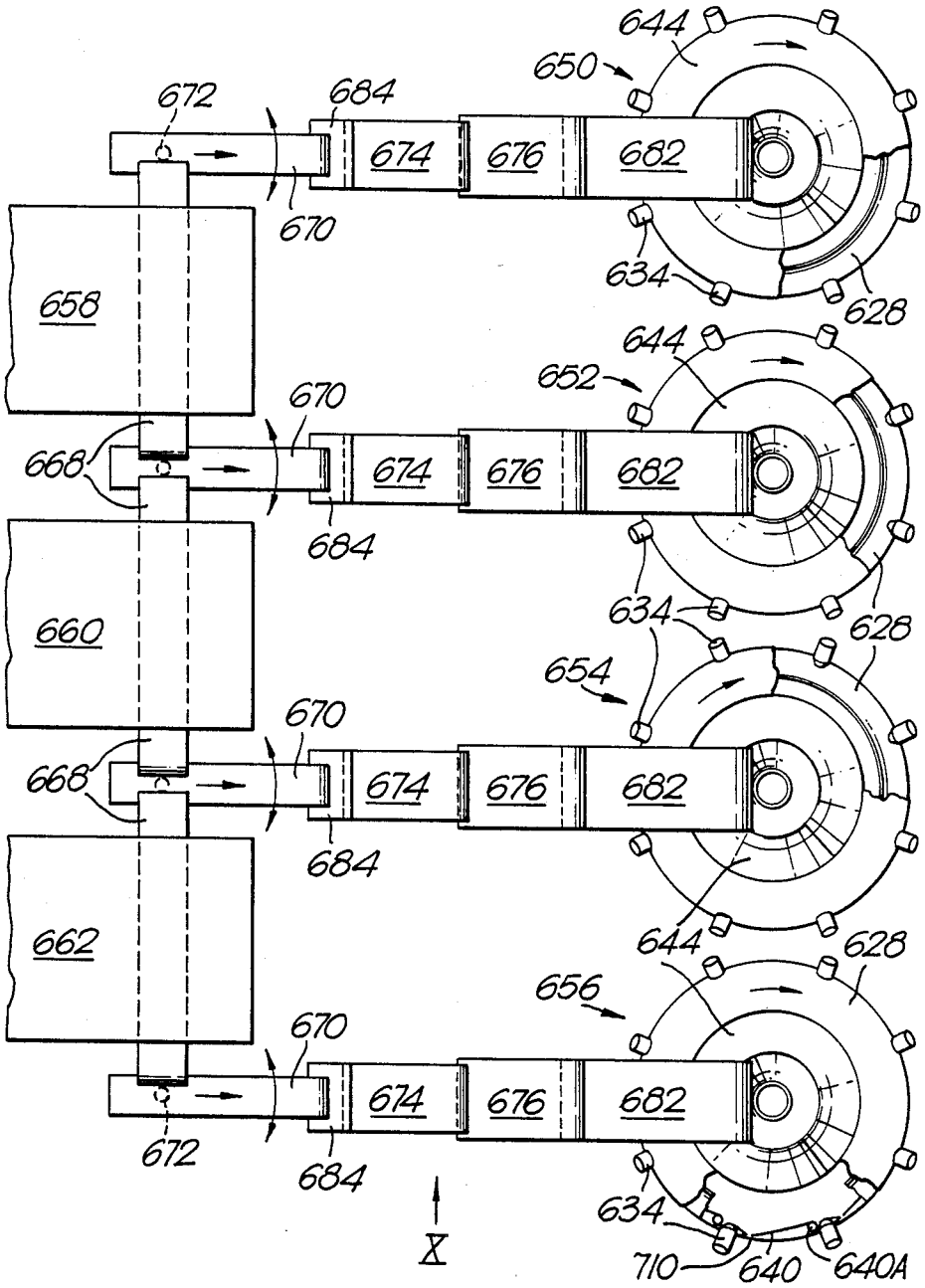
FIG. 9 is a plan view showing four feed tables (modified forms of that shown in FIGS. 7 and 8) with provision for feeding tobacco thereto.

FIG. 9 shows an arrangement whereby four rotary feed tables 650, 652, 654 and 656 may be fed with tobacco from three tobacco silos 658, 660 and 662.

As shown particularly in FIG. 10, each silo includes a set of spiked rotary doffers 664 arranged to remove tobacco from the end of a deep pile of tobacco carried by a conveyor 666. Tobacco removed by the doffers 664 drops onto a lateral conveyor 668 which is reversible so as to be able to deliver tobacco onto either of two further upwardly inclined conveyors 670. Each conveyor 670 is carried by a turret 672 which oscillates about its vertical axis so as to spread the tobacco from the conveyor 670 across a wider conveyor 674 which is in the form of a smooth band. The band 674 moves slowly so that a relatively thick carpet of tobacco (not shown) forms on it and is carried towards an elevator 676 which may be constructed in essentially the manner described in our British patent specification No. 1587815. Lumps of tobacco are knocked off the elevator by a refuser roller 678, and the tobacco on the elevator is finally removed by an unravelling spiked roller 680; the tobacco falls onto a further conveyor 682 which delivers the tobacco into the conical annular space of the corresponding feed table.

It will be understood that the conveyor 682 is driven at a relatively high speed (e.g. one meter per second so that the tobacco, which is opened up by the elevator and cooperating parts, is carried on the conveyor 682 as a relatively thin loose carpet.

A pressure detecting plate 684 controls the speed of the silo band 666 and lateral conveyor 668 in order to build up tobacco to a substantially uniform thickness on the conveyor 674. A photoelectric device (626 in FIG. 7) detecting the height of tobacco in the conical intermediate buffer of the feed table controls the speed of the elevator 676 and conveyor 674.

Instead of oscillating on the turret 672, the conveyor 670 may extend upwards at a steeper angle (to gain more height) and may deliver the tobacco into a chute which oscillates sideways about its upper end and preferably also lengthwise of the conveyor 674. The lengthwise oscillation will, by spreading the tobacco along the conveyor 674, help to produce a tobacco carpet of uniform height along the conveyor 674; in that case, control of the delivery rate of tobacco to the conveyor 670 may be achieved simply by means of a photoelectric device mounted approximately midway along the conveyor 674 at approximately the desired height of the tobacco carpet.

If the tobacco is delivered to the rotary table in a relatively loose condition, the form of table shown in FIGS. 7 and 8 is believed to be preferable. The loose condition of the tobacco enables the roof member 628 to be mounted relatively close to the table. However, if the tobacco is in a relatively lumpy condition when it reaches the rotary table, then it may be preferable to use the modified form of table shown in FIGS. 9 and 10, and the roof member 728 would in that case be mounted further from the correspondingly sloping peripheral portion of the table; then, in order to feed tobacco into each pipe 634 at the same rate as before, the table would rotate at a lower speed, for example 12 r.p.m..

Figure 11:
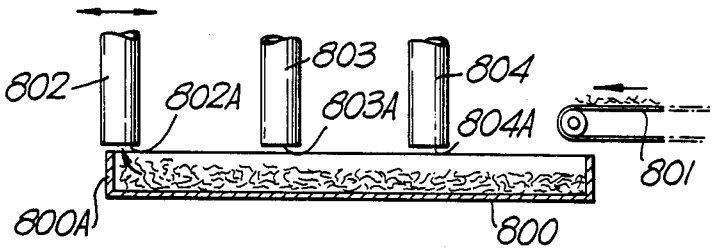
FIG. 11 is a diagrammatic side view of another different example.

FIG. 11 shows a feed table 800 which moves with a vibratory motion so as to spread evenly tobacco which is fed onto it by a conveyor 801. For example, the feed table may reciprocate vertically or may be driven by an eccentric so as to have a circular motion. The rate at which tobacco is fed onto the table by the conveyor is controlled so as to maintain a layer of tobacco of substantially constant thickness on the table.

Around the periphery of the table there are a number of pipes of which only three identified by numerals 802 to 804 are shown. Each pipe has an inlet 802A, 803A or 804A which is movable horizontally in a direction transverse to the adjacent part of the side wall of the table, for example side wall 800A in the case of pipe 802; the inlets of the pipes 803 and 804 move normally to the plane of the drawings. Thus a variable proportion of the area of each inlet lies over the table an consequently the rate at which tobacco is picked up by each pipe can be controlled in response to demand by the corresponding cigarette making machines. In this connection it should be understood that the velocity of the air flow up each pipe should be sufficient to pick up all the tobacco lying below the pipe inlet so as to avoid separating small particles of tobacco from longer or heavier particles.

Figure 12:
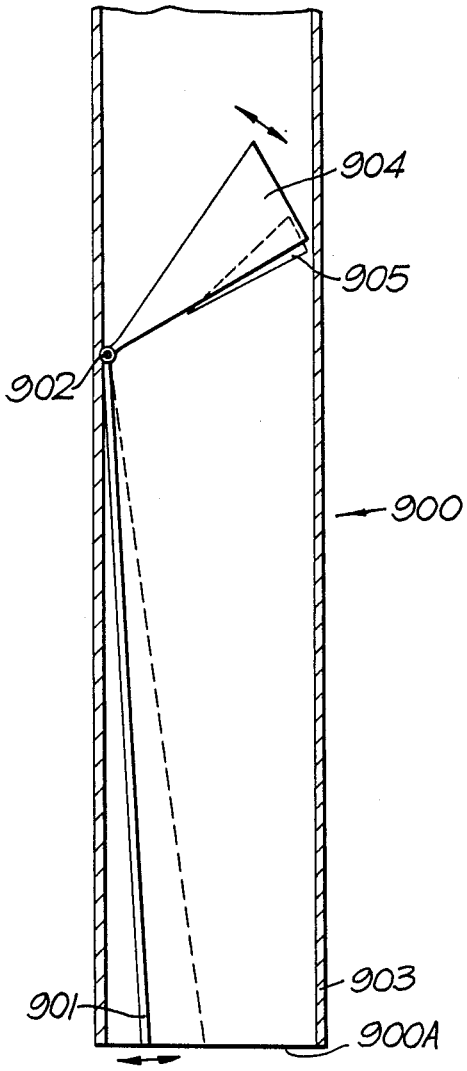
FIG. 12 shows part of another different arrangement.

FIG. 12 shows a pipe 900 arranged to suck up tobacco at a controlled rate from any suitable form of feed table, for example the feed table shown in FIG. 11 or a circular vibratory table or a rotary table.

The inlet portion of the pipe (shown in FIG. 12) is of square cross-section, for example 70×70 mm. However, the effective area of the tobacco inlet 900A of the pipe is determined by the position of a flat plate 901 which is mounted on a rotatable spindle 902. Rotation of the spindle moves the lower end of the plate closer to or further from an opposed wall 903, the effective area of the inlet being a rectangle having a variable width defined by the position of the plate. A smaller inlet is formed with the plate in the position shown in broken outline.

Also attached to the spindle 902 are a pair of triangular members 904 lying close to the outer surfaces of the walls of the pipe which are parallel to the plane of the drawing. These members serve to control the admission of air into the pipe via balancing air inlets 905. When the plate 901 is vertical, providing the maximum inlet for tobacco into the pipe, the balancing air inlets 905 are closed by the respective triangular members 904. The plate 901 and triangular members 904 are shown in intermediate positions in which the tobacco inlet is smaller than the maximum, while some air is admitted through the inlets 905. The arrangement is preferably such that the velocity of the air entering the pipe through the inlet 900A and available to draw up tobacco from the feed table is approximately constant.

I claim:

1. A method of feeding tobacco pneumatically from a common tobacco supply station and substantially continuously to a plurality of cigarette making machines, comprising the steps of supplying tobacco from said supply station to a common tobacco-spreading feed table and feeding tobacco from said common tobacco-spreading feed table through a number of pipes leading to the respective cigarette making machines at an average controlled rate for each pipe which corresponds to the rate at which tobacco is used by the corresponding cigarette making machine by metering the tobacco as it passes through each pipe.

2. A method according to claim 1 in which each pipe includes at a portion intermediate the ends thereof, an associated buffer which receives the tobacco required for that pipe through one end and meters tobacco at a controlled rate from its other end.

3. A method according to claim 1 in which each pipe is arranged to suck up tobacco from the feed table at a rate which is controlled by controlling the area of tobacco lying beneath the inlet of the pipe.

4. Apparatus for use in feeding tobacco pneumatically from a common supply station and substantially continuously to a number of cigarette making machines, comprising a tobacco spreading table and a plurality of feed pipes each having an inlet adjacent to the feed table for receiving tobacco therefrom, an outlet adjacent to a cigarette making machine for feeding tobacco pneumatically thereto, and an intermediate portion consisting of generally parallel pipe portions of which one portion serving as a buffer is arranged to receive tobacco delivered into the pipe inlet and has metering means for continuously feeding tobacco at a controlled rate from its downstream end toward said pipe outlet, while air drawn into the pipe inlet passes through a second pipe portion at least while the pipe is drawing in tobacco through its inlet.

5. Apparatus according to claim 4 including a vent in the inlet or in the second pipe portion (pivoted member) which is controlled by a detector responsive to the tobacco in the first pipe portion, the vent being opened automatically so as to stop the flow of tobacco into the inlet when the quantity of tobacco in the first pipe portion reaches a predetermined value.

6. Apparatus according to claim 4 or claim 5 in which the upstream ends of the intermediate pipe portions are so shaped that centrifugal force on the tobacco causes it to pass into the first pipe portion while the air conveying the tobacco passes into and through the second pipe portion.

7. Apparatus for feeding tobacco pneumatically from a common supply station and substantially continuously to a number of cigarette making machines comprising at the supply station a circular vibratory feed table arranged to convey tobacco along a circular path and having openings through each of which tobacco is arranged to drop into a buffer column associated with one of the cigarette making machines, and including a metering device at the lower end of each buffer column for feeding tobacco from the buffer column at a controlled rate into a feed pipe arranged to convey the tobacco pneumatically to the corresponding cigarette making machine, each opening having means controlling the passage of tobacco into the corresponding buffer column from the feed table.

8. Apparatus for use in feeding tobacco pneumatically from a common supply station and substantially continuously to a number of cigarette making machines, comprising a feed table located at a common supply station for a number of cigarette making machines, means for feeding tobacco onto the feed table, and a number of pipes associated with the respective cigarette making machines and arranged to suck up tobacco substantially continuously from the feed table for delivery pneumatically to the cigarette making machines, each pipe having an inlet and means for controlling the area of the inlet lying above tobacco on the feed table to progressively vary the rate at which tobacco is sucked up from the feed table.

9. Apparatus according to claim 8, in which the feed table is arranged to rotate about a central vertical axis, tobacco fed onto the table being distributed around the periphery of the table by or with the aid of centrifugal force, and including a fixed annular roof member coaxial with the table and evenly spaced from the table so as to define an annular space of substantially uniform height across a radial dimension substantially greater than the said height, and in which each pipe communicates with the annular space near the periphery thereof via an aperture in the roof member.

10. Apparatus according to claim 9 in which control of the rate at which tobacco is sucked up by each pipe is provided for each pipe by a pivoted member forming part of an outer wall of the annular space in the area of that pipe, the pivoted member being pivoted at its upstream end about an axis normal to the table and being controlled as to its position about the pivot so as to vary the radial dimension of the tobacco which passes below the aperture.

11. Apparatus according to claim 10, in which the means for feeding tobacco into the annular space comprises an approximately conical member which is coaxial with the table and is surrounded by a second coaxial approximately conical member forming an approximately conical space of substantially uniform thickness between the two conical members, the said conical space serving as a buffer between the annular space and a feed conveyor which feeds tobacco into the conical space, one of the conical members being rotatably driven at a variable speed to control the delivery of tobacco by centrifugal force into the annular space from the conical space.

12. Apparatus according to claim 8, in which the inlet of each pipe is movable horizontally over a sde wall of the feed table to vary the overlap of the inlet with tobacco on the feed table.

13. Apparatus according to claim 12 in which the feed table is driven with a vibratory motion to spread the tobacco fed onto it by the tobacco feed means.

14. Apparatus according to claim 8 in which each pipe has an inlet defined partly by a movable member whereby the cross-section of the inlet is controlled.

15. Apparatus according to claim 14 including a balancing air inlet in the pipe near the inlet for tobacco, and including a movable part which controls the admission of air through the balancing air inlet so as to admit more air as the cross-section of the tobacco inlet decreases and vice versa.

* * * * *